US011434919B2

(12) United States Patent
Yamazaki et al.

(10) Patent No.: US 11,434,919 B2
(45) Date of Patent: Sep. 6, 2022

(54) WATER PUMP

(71) Applicant: YAMADA MANUFACTURING CO., LTD., Kiryu (JP)

(72) Inventors: Takashi Yamazaki, Kiryu (JP); Ichiro Takayama, Kiryu (JP); Tomokazu Sato, Kiryu (JP)

(73) Assignee: YAMADA MANUFACTURING CO., LTD., Kiryu (JP)

( * ) Notice: Subject to any disclaimer, the term of this patent is extended or adjusted under 35 U.S.C. 154(b) by 0 days.

(21) Appl. No.: 17/188,155

(22) Filed: Mar. 1, 2021

(65) Prior Publication Data

US 2021/0301829 A1 Sep. 30, 2021

(30) Foreign Application Priority Data

Mar. 25, 2020 (JP) ..... JP2020-053923
Mar. 25, 2020 (JP) ..... JP2020-053924
Sep. 7, 2020 (JP) ..... JP2020-149606

(51) Int. Cl.
*F04D 29/046* (2006.01)
*F04D 13/02* (2006.01)
*F04D 29/043* (2006.01)
*F04D 29/08* (2006.01)

(52) U.S. Cl.
CPC ..... *F04D 29/046* (2013.01); *F04D 13/02* (2013.01); *F04D 29/043* (2013.01); *F04D 29/086* (2013.01)

(58) Field of Classification Search
CPC .... F04D 13/021; F04D 29/043; F04D 29/046; F04D 29/086; F04D 29/126
See application file for complete search history.

(56) References Cited

U.S. PATENT DOCUMENTS 5,125,795 A * 6/1992 Suzuki ..... F04D 29/126 416/169 A
9,719,522 B2 * 8/2017 Yamamoto ..... F04D 13/02

FOREIGN PATENT DOCUMENTS

CN 1348066 A * 5/2002
JP 03-065891 6/1991
JP 2014227984 A * 12/2014

OTHER PUBLICATIONS

Machine translation of JP 2014-227984, Kurano et al, published Dec. 8, 2014 (Year: 2014).*
Machine translation of CN 1348066, Arano et al, published May 8, 2002 (Year: 2002).*

* cited by examiner

*Primary Examiner* — Richard A Edgar
*Assistant Examiner* — Jason G Davis
(74) *Attorney, Agent, or Firm* — Rankin, Hill & Clark LLP

(57) ABSTRACT

A water pump includes a support portion provided with a bearing hole, and a pulley which is provided at one end of a rotation shaft and which is formed in a cylindrical shape with a bottom. The support portion includes an annular small-diameter portion provided with the bearing hole at the center, and an annular large-diameter portion. At least a part of the small-diameter portion is located at the pulley side relative to the large-diameter portion. An annular first clearance is formed between the cylindrical portion of the pulley and the large-diameter portion. A second cylindrical portion is provided on the bottom portion of the pulley. An annular second clearance is formed between the second cylindrical portion and the small-diameter portion.

18 Claims, 4 Drawing Sheets

WATER PUMP

FIELD OF THE INVENTION

The present disclosure relates to a water pump that is driven by a pulley.

BACKGROUND

A coolant for cooling an engine is circulated by a water pump. Patent Document 1 discloses a conventional technology regarding a water pump.

The water pump disclosed in Patent Document 1 includes a support portion in which a bearing room supporting a bearing is formed in the horizontal direction, an impeller drive shaft which is supported by the bearing so as to be rotatable, and which passes completely through the bearing room, a pulley which is provided at one-end side of the impeller drive shaft and which is driven by a belt, an impeller provided at the other-end side of the impeller drive shaft, and a mechanical seal provided between the impeller and the bearing. When the pulley is driven by the belt, the impeller provided at the impeller drive shaft is rotated, and thus a coolant is fed out.

[Patent Document 1] JP H03-65891 A

The pulley is formed in a cylindrical shape with a bottom, and surrounds the annular support portion. An annular clearance is formed between the outer circumference of the support portion and the inner circumference of cylindrical portion of the pulley.

Under an operating circumstance in which the water pump is actuated, dusts, debris, muds, sands, water and oil (which will be collectively referred to as dusts below) may enter the annular clearance formed between the pulley and the support portion. The lifetime of the bearing is reduced if the entering dusts reach the interior of the bearing.

A divider in a disk shape is provided on the outer circumference of the support portion. By providing the divider, the clearance between the pulley and the support portion is reduced. This prevents dusts from entering the internal side of the pulley.

This divider is fastened to the outer circumference of the support portion by press-fitting or by swaging. As described above, the support portion is a portion that supports the bearing. When external force acts on the support portion at the time of press-fitting or swaging of the divider, there is a possibility such that a load is applied to the bearing, resulting in the reduction of the lifetime of the bearing.

An objective of the present disclosure is to provide a technology that can extend the lifetime of a water pump.

SUMMARY OF THE INVENTION

A water pump according to a first example embodiment of the present disclosure includes:

a support portion provided with a bearing hole that supports a bearing;

a rotation shaft which is rotatably supported by the bearing and which passes completely through the bearing hole;

a pulley which is provided at one end of the rotation shaft and which is formed in a cylindrical shape with a bottom;

an impeller provided at the other end of the rotation shaft; and a sealing member placed between the impeller and the bearing, in which:

the support portion is provided with a through-hole capable of causing a space in the bearing hole between the sealing member and the bearing to be in communication with an exterior of the support portion;

the support portion includes: an annular small-diameter portion provided with the bearing hole at a center; and an annular large-diameter portion that has a larger diameter of an outer circumference than a diameter of an outer circumference of the small-diameter portion;

at least a part of the small-diameter portion is located at the pulley side relative to the large-diameter portion;

an annular first clearance is formed between a cylindrical portion of the pulley and the large-diameter portion;

a second cylindrical portion is provided on the bottom of the pulley; and an annular second clearance is formed between the second cylindrical portion and the small-diameter portion.

According to a second example embodiment of the present disclosure, in the above-described water pump, a dimension in an axial direction in which the cylindrical portion of the pulley and the large-diameter portion of the support portion overlap with each other is defined as a first dimension;

a dimension in the axial direction in which the second cylindrical portion and the small-diameter portion of the support portion overlap with each other is defined as a second dimension; and the first dimension is shorter than the second dimension.

According to a third example embodiment of the present disclosure, in the above-described water pump, a dimension of at least either one of the first clearance or the second clearance in a radial direction is designed so as to decrease toward the impeller with reference to a direction in which a center line of the bearing hole extends.

According to a fourth example embodiment of the present disclosure, in the above-described water pump;

the support portion comprises an opposing surface that faces with the bottom of the pulley; and recesses are formed in the opposing surface in addition to the through-hole.

According to a fifth example embodiment of the present disclosure, in the above-described water pump;

the large-diameter portion surrounds the small-diameter portion;

with reference to a radial direction, a thickness of the large-diameter portion is thinner than a thickness of the small-diameter portion; and the recess is formed by a space between the small-diameter portion and the large-diameter portion.

According to a sixth example embodiment of the present disclosure, in the above-described water pump, a plurality of ribs is formed from the outer circumference of the small-diameter portion to an inner circumference of the large-diameter portion.

According to a seventh example embodiment of the present disclosure, in the above-described water pump:

a center line of the bearing hole extends in a horizontal direction; and some of the recesses formed in the opposing surface are located upwardly relative to an upper end of the bearing.

According to the first example embodiment, the water pump includes the support portion that supports the rotation shaft, and the pulley in a cylindrical shape with a bottom provided at the one end of the rotation shaft. The support portion includes the annular small-diameter portion provided with the bearing hole at the center, and the annular large-diameter portion that has a larger diameter of an outer circumference than that of an outer circumference of the small-diameter portion.

At least a part of the small-diameter portion is located at the pulley side relative to the large-diameter portion. The annular first clearance is formed between a cylindrical portion of the pulley and the large-diameter portion. The second cylindrical portion is provided on the bottom portion of the pulley. The annular second clearance is formed between the second cylindrical portion and the small-diameter portion.

That is, formed between the pulley and the support portion are the two clearances that prevent dusts from entering therein. Accordingly, dusts are not likely to reach the interior of the bearing.

In addition, the second cylindrical portion is provided on the bottom portion of the pulley. Since the second cylindrical portion is not engaged with the support portion, no external force is applied to the support portion. Consequently, a load is not applied to the bearing that is provided at the support portion, and thus the lifetime of the bearing can be extend.

Moreover, the second cylindrical portion is provided on the pulley that is a rotation body. Rotation of the pulley causes the second cylindrical portion to rotate. An airflow is likely to be produced in the second clearance between the second cylindrical portion and the small-diameter portion of the support portion. This prevents dusts from entering in the second clearance.

According to the second example embodiment, the dimension in an axial direction in which the cylindrical portion of the pulley and the large-diameter portion of the support portion overlap with each other is defined as a first dimension. A dimension in the axial direction in which the second cylindrical portion and the small-diameter portion of the support portion overlap with each other is defined as a second dimension. The first dimension is shorter than the second dimension.

The first clearance is an inlet of dusts into the pulley, and also an outlet of dusts which have entered the interior. Reduction of the first dimension causes the dusts to be likely to be ejected to the exterior of the pulley from the first clearance even if such dusts enter in the pulley from the first clearance.

According to the third example embodiment, a dimension of at least either one of the first clearance or the second clearance in a radial direction is designed so as to decrease toward the impeller with reference to a direction in which a center line of the bearing hole extends. Since the clearance at the impeller side that is a side from which dusts enter is designed so as to be narrow, the dusts are prevented from entering therein. Hence, the lifetime of the water pump can be extended.

According to the fourth example embodiment, dusts entering from the first clearance may reach the edge of the opposing surface that faces the bottom portion of the pulley. The pulley is formed in a cylindrical shape with a bottom, and when the pulley rotates, an airflow is produced inside the pulley. Hence, external force outwardly in the radial direction due to the airflow is also acts on the dusts. The opposing surface is provided with not only the through-hole but also the recess. Some dusts enter the recess. The dusts which enter the recess are apart from the bearing. The dusts can be kept away from the bearing, and thus the dusts are not likely to enter the bearing.

Even if the dusts that entered the recess move toward the bearing, the movement distance until reaching to the bearing is increased in comparison with a case in which dusts move on a flat surface where no recess is formed. Hence, the dusts are not likely to reach the bearing.

Because of the similar reason to the above-described reason, the dusts are not likely to reach the outlet of the through-hole. Accordingly, the lifetime of the water pump can be extended.

According to the fifth example embodiment, with reference to the radial direction of the small-diameter portion and of the large-diameter portion, the thickness of the large-diameter portion is thinner than that of the small-diameter portion. The recess is formed by the space between the small-diameter portion and the large-diameter portion. Hence, a further large recess can be formed between the small-diameter portion and the large-diameter portion. Dusts are further likely to enter the recess. The dusts can be kept away from the bearing, and thus the dusts are not likely to reach the bearing. Accordingly, the lifetime of the water pump can be extended.

According to the sixth example embodiment, the plurality of ribs is formed from the outer circumference of the small-diameter portion to an inner circumference of the large-diameter portion. That is, the recess formed by the space between the small-diameter portion and the large-diameter portion is divided by the plurality of ribs into a plurality of segments. Hence, when dusts that enter the recess move toward the through-hole through the surface of the recess, the ribs disrupt the movement of dusts. This prevents the dusts from coming close to the through-hole.

In addition, since the ribs are formed, when the pulley rotates, a turbulence flow of air is likely to be produced in the pulley. External force by the turbulence flow of air is likely to act on the dusts, making the dusts further difficult to reach the bearing. Accordingly, the lifetime of the water pump can be extended.

According to the seventh example embodiment, the center line of the bearing hole extends in the horizontal direction. Some of the recesses formed in the opposing surface are located upwardly relative to an upper end of the bearing. Even if dusts move toward the bearing because of the gravity, since the dusts enter the recess formed on the upper end of the bearing, the dusts are not likely to reach the bearing. Consequently, the dusts are not likely to enter the bearing, and thus the lifetime of the water pump can be extended.

DETAILED DESCRIPTION OF THE EMBODIMENTS

Embodiments to carry out the present disclosure will be described below with reference to the accompanying figures.

Embodiment

Figure 1:
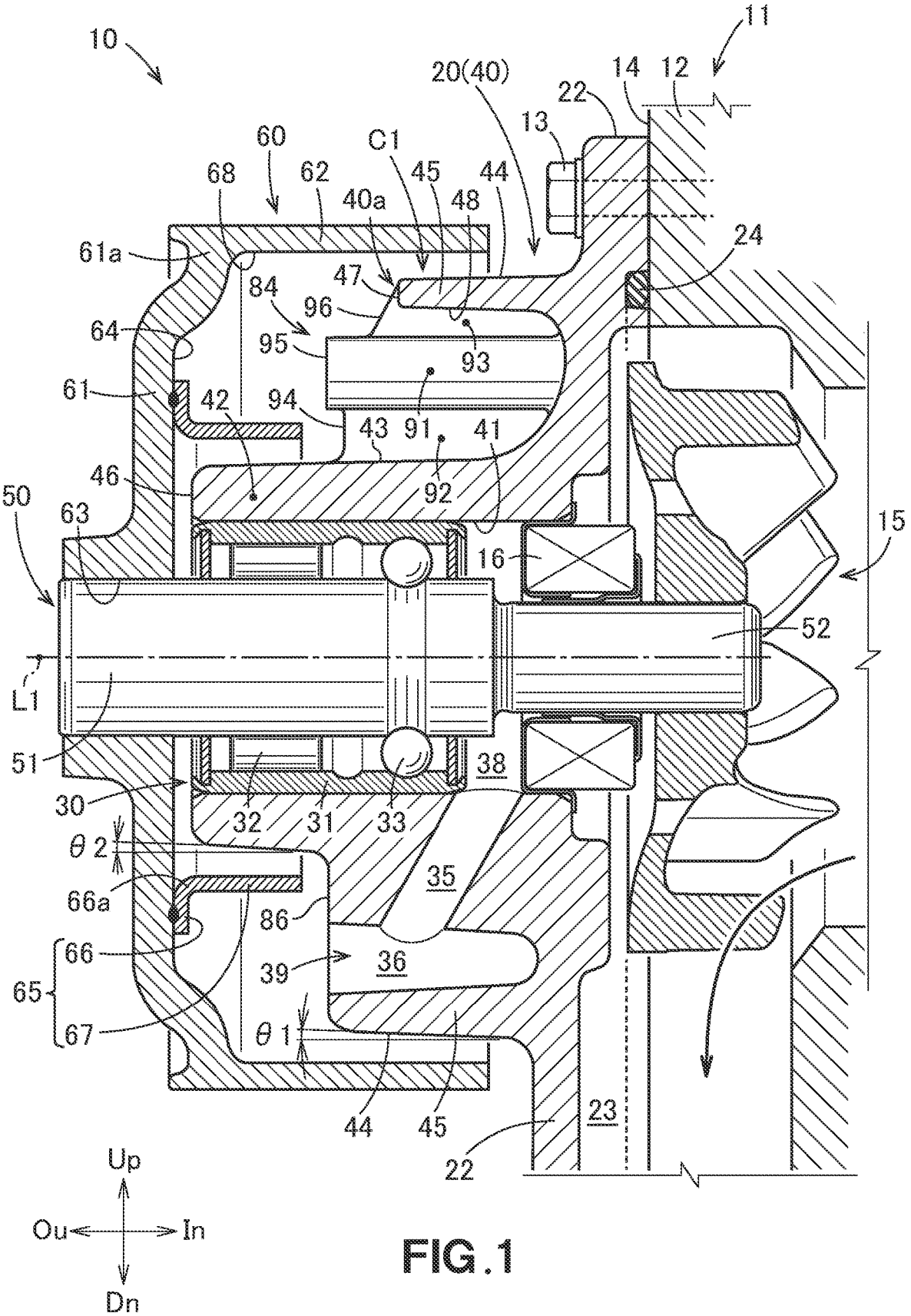
FIG. 1 is cross-sectional view of a water pump according to an embodiment of the present disclosure.

FIG. 1 illustrates a water pump 10 according to an embodiment. This water pump 10 circulates a coolant for cooling an engine 11. The water pump 10 is fastened by fastening members 13 to an engine block 12 of a heavy industrial machine like a power shovel, or a vehicle, etc.

Figure 2:
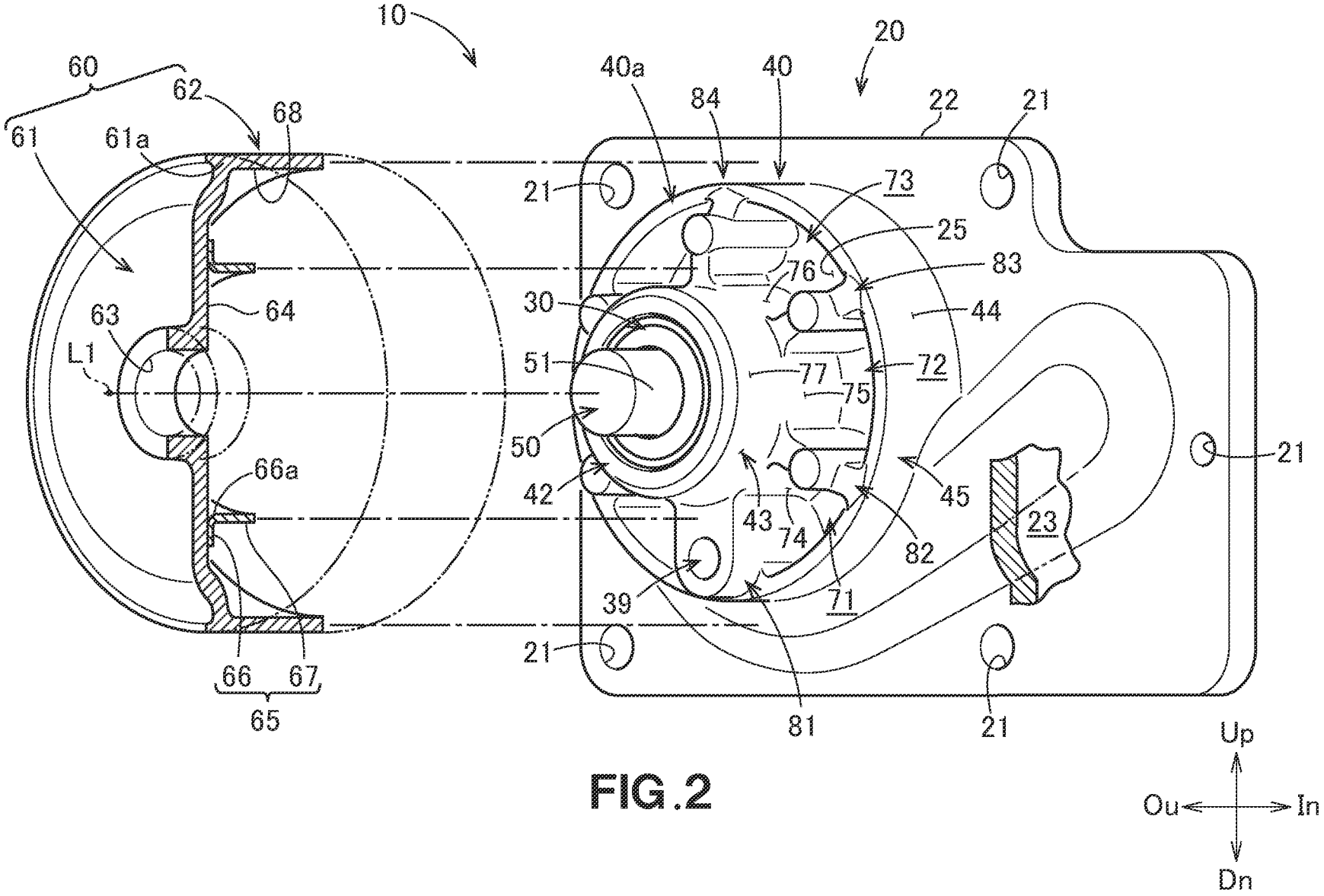
FIG. 2 is an exploded perspective view of the water pump illustrated in FIG. 1.

With reference to FIG. 1 and FIG. 2, a housing 20 of the water pump 10 is a cast product, and includes a fastened portion 22 in a plate shape provided with a plurality of (e.g., five) fastening holes 21 in which each fastening member 13 passes completely through, and a support portion 40 in which a bearing hole 41 to support a bearing 30 is formed.

A center line L1 of the bearing hole 41 of the support portion 40 extends in the horizontal direction. A flow passage 23 of the coolant is formed in the inner surface (a surface at the engine-block-12 side) of the fastened portion 22. A sealing member 24 is provided between the housing 20 and a side face 14 of the engine block 12.

In the following description, the "inner side (In)" is at the impeller-15 side to be described later, and the "outer side (Ou)" is the pulley-60 side to be described later with reference to the horizontal direction. The "down (Dn)" side is a lower side in the vertical direction, and the "upper (Up)" side is an upper side in the vertical direction.

The bearing 30 includes an annular member 31 which is engaged with the bearing hole 41, and a cylindrical rolling body 32 and spherical rolling bodies 33 both arranged inside the annular member 31.

A rotation shaft 50 supported by the bearing 30 so as to be rotatable is provided in the bearing hole 41 of the support portion 40. This rotation shaft 50 passes completely through the bearing hole 41 in the axial direction. A pulley 60 which is driven by a belt is provided at an end portion 51 (one end) of the rotation shaft 50 at the outer side. An impeller 15 is provided at an end portion 52 (the other end) of the rotation shaft 50 at the inner side. When the pulley 60 is driven, the impeller 15 provided at the rotation shaft 50 is rotated, and thus the coolant passes through the flow passage 23 and is fed out.

A mechanical seal 16 (a sealing member) is provided between the impeller 15 and the bearing 30. The mechanical seal 16 occupies the clearance between the rotation shaft 50 and the bearing hole 41, and prevents the coolant from entering in the bearing hole 41. The detailed description of the mechanical seal 16 will be omitted. Sealing members, such as a packing or an oil seal, may be adopted instead of the mechanical seal 16.

The pulley 60 is formed in a cylindrical shape with a bottom as a whole, and includes a bottom portion 61 in a disk shape, and a cylindrical portion 62 (a first cylindrical portion) in a hollow cylinder shape extended from a circumferential edge 61*a* of the bottom portion 61 toward the inner side. A fastening hole 63 in which the end portion 51 of the rotation shaft 50 at the outer side is press-fitted so as to be fastened therewith is formed in the bottom portion 61.

A cylindrical body 65 is provided on an inner surface 64 of the bottom portion 61. The cylindrical body 65 includes an annular flange portion 66 welded to the inner surface 64 of the bottom portion 61 of the pulley 60, and a second cylindrical portion 67 in a hollow cylindrical shape extended toward the inner side from an inner circumferential edge 66*a* of the flange portion 66 at the inner side in the radial direction. Note that the second cylindrical portion 67 may be formed integrally with the pulley 60 as a singular component.

Figure 3:
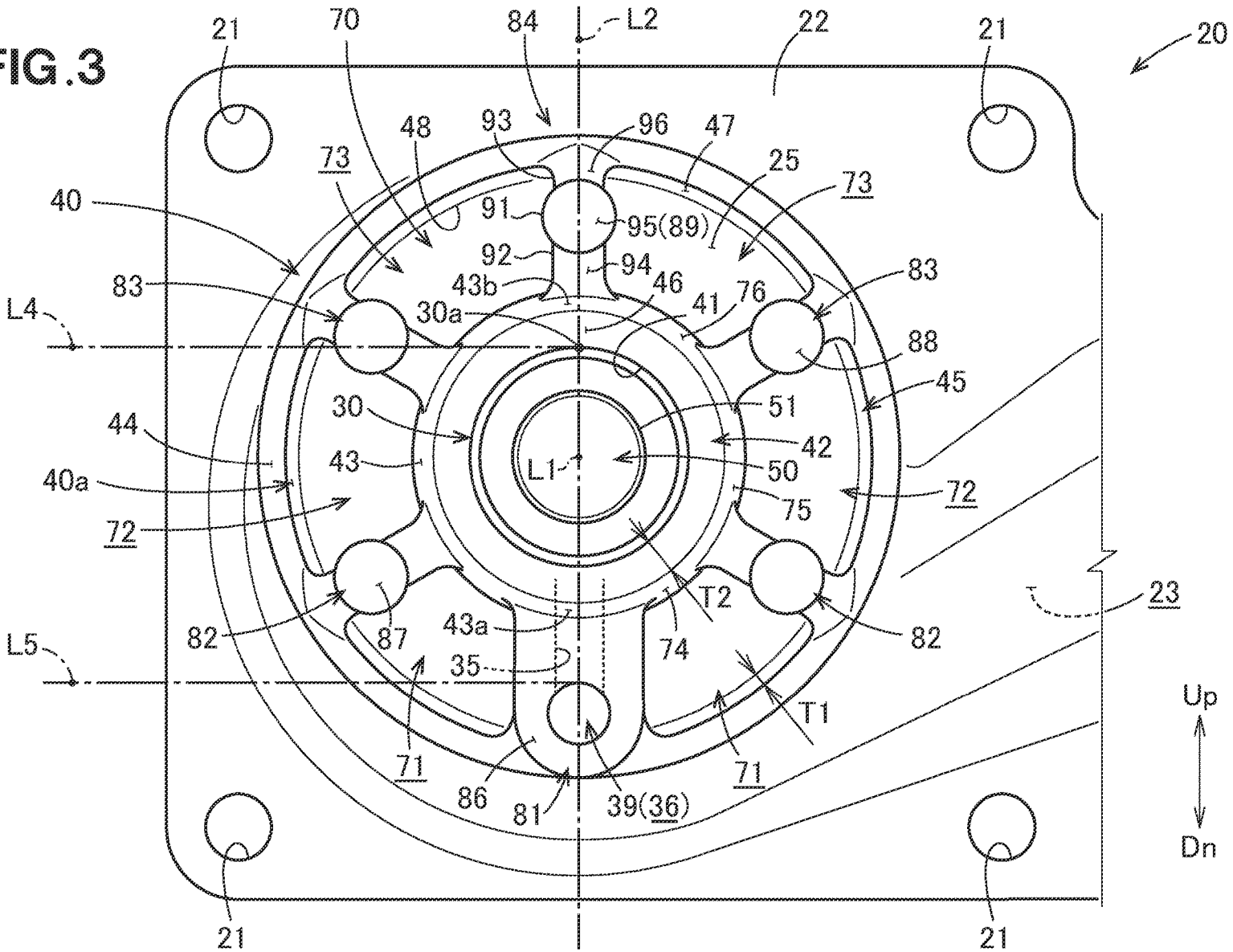
FIG. 3 is a diagram for describing a support portion of the water pump illustrated in FIG. 2.

With reference to FIG. 3, as viewed in a direction along the center line L1 (also referred to as an axial direction), the support portion 40 includes an annular small-diameter portion 42 provided with the bearing hole 41 formed at the center, and an annular large-diameter portion 45 that has a larger diameter of an outer circumference 44 than that of an outer circumference 43 of the small-diameter portion 42.

The large-diameter portion 45 surrounds the small-diameter portion 42 around the center line L1. A thickness T1 of the large-diameter portion 45 is thinner than a thickness T2 of the small-diameter portion 42 (T1<T2) with reference to the radial direction of the small-diameter portion 42 and of the large-diameter portion 45.

With reference to FIG. 1, an end face 46 of the small-diameter portion 42 is located outwardly (at the pulley side) relative to an end face 47 of the large-diameter portion 45. The outer circumference 44 of the large-diameter portion 45 is inclined (at an inclination angle θ1) in such a way that the diameter of the outer circumference 44 decreases toward the outer side. Similarly, the outer circumference 43 of the small-diameter portion 42 is inclined (at an inclination angle θ2) in such a way that the diameter of the outer circumference 43 decreases toward the outer side.

With reference to FIG. 3, an annular space surrounded by the outer circumference 43 of the small-diameter portion 42, an inner circumference 48 of the large-diameter portion 45, and a bottom surface 25 of the fastened portion 22 will be defined as a recess 70. This recess 70 is divided into six segments by a plurality of (e.g., four sets) ribs 81 to 84 to be described later. The ribs 81 to 84 are each formed radially to the inner circumference 48 of the large-diameter portion 45 from the outer circumference 43 of the small-diameter portion 42. The ribs 81 to 84 are provided at an equal pitch in the circumferential direction.

The rib that extends downwardly from a lower end 43*a* of the outer circumference 43 of the small-diameter portion 42 among the ribs 81 to 84 will be defined as the first rib 81. The first rib 81 is formed in a block shape, and has a dimension that is set so as to be thicker than the other ribs 82 to 84 in the circumferential direction.

With reference to FIG. 1 and FIG. 3, the first rib 81 is provided with a through-hole 39 that can cause a space 38 between the mechanical seal 16 and the bearing 30 in the bearing hole 41 to be in communication with the exterior of the support portion 40. The through-hole 39 includes a first hole 35 that extends outwardly in the radial direction from the space 38, and a second hole 36 which is in communication with the first hole 35, and which extends outwardly. The outlet of the through-hole 39 is located in an end face 86 of the first rib 81.

The ribs that extend obliquely and downwardly from the outer circumference 43 of the small-diameter portion 42 among the ribs 82 to 84 will be defined as second ribs 82 and 82. The ribs that extend obliquely and upwardly from the outer circumference 43 of the small-diameter portion 42 will be defined as third rib 83 and 83, and the rib that extends upwardly from an upper end 43*b* of the outer circumference 43 of the small-diameter portion 42 will be defined as a fourth rib 84.

The fourth rib 84 includes a circular cylinder portion 91 located at the substantial center in the radial direction, an inner wall portion 92 located inwardly in the radial direction relative to the circular cylinder portion 91, and an outer wall portion 93 located outwardly in the radial direction relative to the circular cylinder portion 91.

An end face 94 of the inner wall portion 92 is located inwardly relative to an end face 95 of the circular cylinder portion 91. An end face 96 of the outer wall portion 93 is inclined inwardly toward the outer side in the radial direction. The end face 95 of the circular cylinder portion 91 is a surface that is depressed when the housing 20 is demolded from a metal mold.

Note that the second ribs 82 and the third ribs 83 have the same dimension and shape as those of the fourth rib 84. Hence, the detailed description thereof will be omitted. Moreover, except the first rib 81 that forms the through-hole 39, the second ribs 82 to the fourth rib 84 may be eliminated.

With reference to FIG. 3, the support portion 40 employs a symmetrical structure with reference to a line L2 which is orthogonal to the center line L1 and which extends in the vertical direction. A structure at the right side relative to the line L2 will be described. The description on the left side relative to the line L2 is similar to the description on the right side.

The space 38 between the first rib 81 and the second rib 82 will be defined as a first recess 71. The space 38 between the second rib 82 and the third rib 83 will be defined as a second recess 72. The space 38 between the third rib 83 and the fourth rib 84 will be defined as a third recess 73. The description is also applicable to the structure at the left relative to the line L2. Hence, such a description will be omitted.

With reference to FIG. 2, a surface in the outer circumference 43 of the small-diameter portion 42 which forms a part of the first recess 71 will be defined as a first curved surface 74, a surface that forms a part of the second recess 72 will be defined as a second curved surface 75, and a surface that forms a part of the third recess 73 will be defined as a third curved surface 76. In the outer circumference 43 of the small-diameter portion 42, a surface located outwardly relative to the ribs 81 to 84 will be defined as an annular surface 77. The annular surface 77 can be also referred to as a surface that does not form the recess 70.

Figure 4:
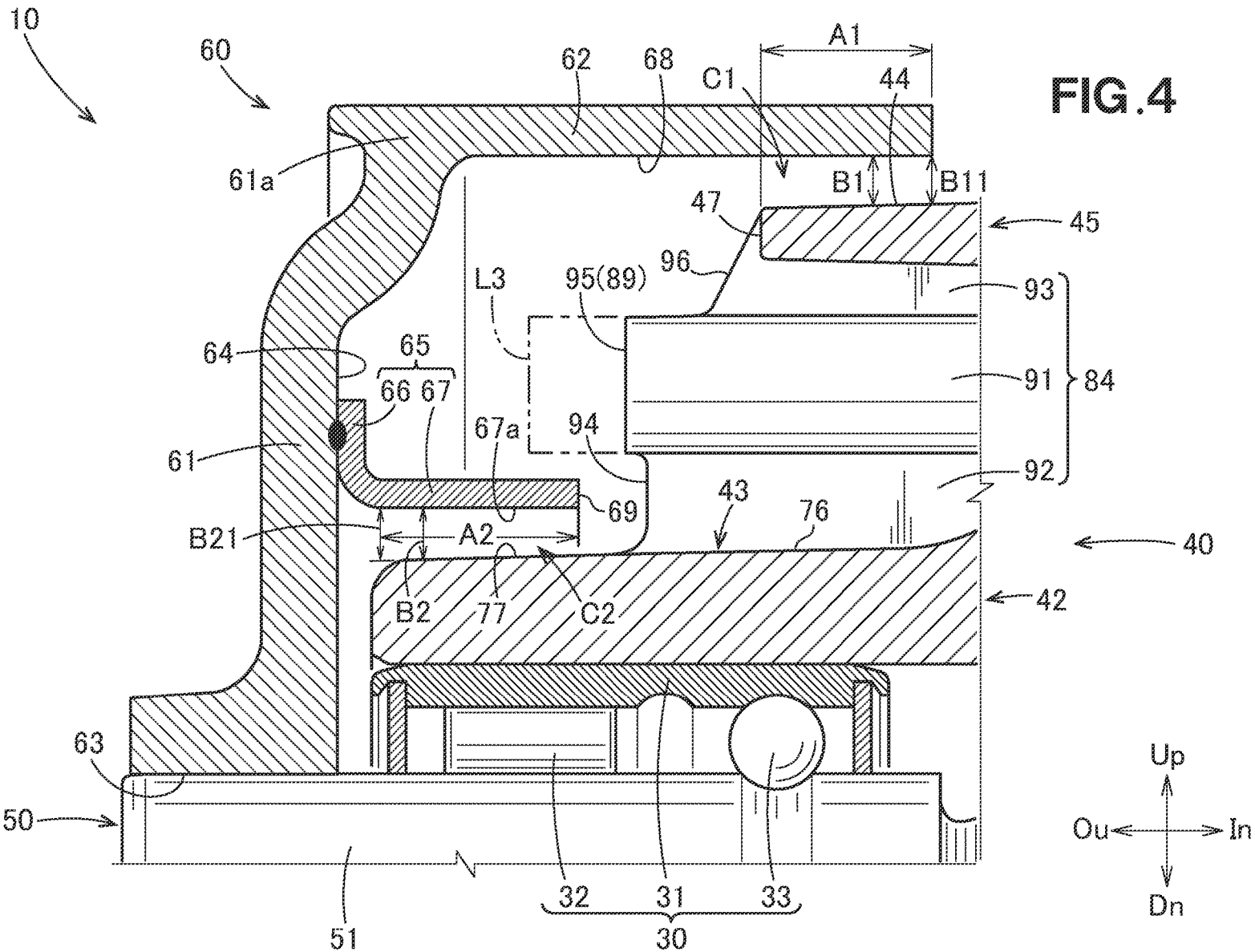
FIG. 4 is a diagram illustrating a part of the water pump illustrated in FIG. 1 in an enlarged manner.

With reference to FIG. 4, an annular first clearance C1 is formed between the inner circumference 68 of the cylindrical portion 62 of the pulley 60 and the outer circumference 44 of the large-diameter portion 45. The annular surface 77 is located outwardly (Ou) relative to the outer circumference 44 of the large-diameter portion 45. An annular second clearance C2 is formed between an inner circumference 67*a* of the second cylindrical portion 67 and the annular surface 77 of the small-diameter portion 42.

The outer circumference 44 of the large-diameter portion 45 is inclined (at an inclination angle θ1 (see FIG. 1)) toward the inner side (at the impeller-15 side) in such a way that the diameter of the outer circumference 44 increases. Hence, a dimension B1 of the first clearance C1 in the radial direction decreases toward the inner side (at the impeller-15 side (see FIG. 1)). It decreases at the inner side, but increases at the outer side (at the pulley-60 side). Since a side from which dusts enter is narrow, the dusts can be prevented from entering therein. The outer circumference 43 of the small-diameter portion 42 is also inclined, and thus the same effect as described above can be accomplished. Furthermore, the outer circumference 43 of the small-diameter portion 42 is inclined (at the inclination angle θ2 (see FIG. 1)) toward the inner side (at the impeller-15 side) in such a way that the diameter of the outer circumference 43 increases. Hence, a dimension B2 of the second clearance C2 in the radial direction decreases toward the inner side (at the impeller-15 side (see FIG. 1)). It decreases at the inner side, but increases at the outer side (at the pulley-60 side). Since the side from which dusts enter is narrow, the dusts can be prevented from entering therein.

A dimension in which the cylindrical portion 62 of the pulley 60 and the large-diameter portion 45 of the support portion 40 overlap with each other with reference to the horizontal direction (a direction in which the center line L1 of the rotation shaft 50 extends) will be defined as a first dimension A1. A dimension in which the second cylindrical portion 67 and the small-diameter portion 42 overlap with each other will be defined as a second dimension A2. The first dimension A1 is shorter than the second dimension A2.

The second cylindrical portion 67 is located inwardly in the radial direction of the rotation shaft 50 relative to the circular cylinder portion 91. Hence, the dimension of the water pump 10 in the axial direction can be reduced. An end face 69 of the second cylindrical portion 67 is located outwardly (Ou) in the axial direction relative to the end face 47 of the large-diameter portion 45. Similarly, the end face 69 is located outwardly (Ou) in the axial direction relative to the end faces 94 to 96. Note that a structure may be employed in which the second cylindrical portion 67 and circular cylinder portion 91 overlap with each other in the axial direction of the rotation shaft 50 (with reference to a line L3).

With reference to FIG. 1 and FIG. 3, a supplemental description will be given. The bearing hole 41, the small-diameter portion 42, the large-diameter portion 45, the rotation shaft 50, the pulley 60, and the second cylindrical portion 67 are placed concentrically around the center line L1.

Advantageous effects of the embodiment will be described.

With reference to FIG. 4, the annular first clearance C1 is formed between the inner circumference 68 of the cylindrical portion 62 of the pulley 60 and the outer circumference 44 of the large-diameter portion 45. The cylindrical body 65 is provided on the bottom portion 61 of the pulley 60. The annular second clearance C2 is formed between the second cylindrical portion 67 of this cylindrical body 65 and the small-diameter portion 42. That is, formed between the pulley 60 and the support portion 40 are the two clearances C1 and C2 that prevent dusts from entering therein. Accordingly, dusts are not likely to reach the interior of the bearing 30.

In addition, the second cylindrical portion 67 is provided on the bottom portion 61 of the pulley 60. Since the second cylindrical portion 67 is not engaged with the support portion 40, no external force is applied to the support portion 40. Consequently, a load is not applied to the bearing 30 that is provided at the support portion 40, and thus the lifetime of the bearing 30 can be extend.

Moreover, the second cylindrical portion 67 is provided on the pulley 60 that is a rotation body. Rotation of the pulley 60 causes the second cylindrical portion 67 to rotate. An airflow is likely to be produced in the second clearance C2 between the second cylindrical portion 67 and the small-diameter portion 42 of the support portion 40. This prevents dusts from entering in the second clearance C2.

Furthermore, the first dimension A1 is shorter than the second dimension A2. The first clearance C1 is an inlet of dusts into the pulley 60, and also an outlet of dusts which have entered the interior. Reduction of the first dimension A1 causes the dusts to be likely to be ejected to the exterior of the pulley 60 from the first clearance C1 even if such dusts enter in the pulley 60 from the first clearance C1. Note that the dimension B1 of the first clearance C1 in the radial direction becomes the minimum at the innermost side. This minimum dimension will be defined as a dimension B11. The dimension B2 of the second clearance C2 in the radial direction becomes the maximum at the outermost side. This maximum dimension will be defined as a dimension B21. When, for example, the dimension B11 is designed to be larger than the dimension B21 (B11>B21), even if dusts enter in the pulley 60 from the first clearance C1, the dusts are likely to be ejected to the exterior of the pulley 60 from the first clearance C1.

With reference to FIG. 1, still further, the outer circumference 44 of the large-diameter portion 45 is inclined (at the inclination angle θ) in such a way that the diameter of the outer circumference 44 decreases toward the outer side (at the pulley-60 side). Hence, dusts that stick to the lower surface in the outer circumference 44 relative to the center line L1 move toward the inner side so as to be apart from the bearing 30. This prevents dusts from entering in the bearing 30.

Other advantageous effects will be described.

With reference to FIG. 1 and FIG. 3, the annular first clearance C1 is formed between the cylindrical portion 62 of the pulley 60 and the support portion 40 that is supporting the rotation shaft 50.

A surface of the support portion 40 which faces the bottom portion 61 of the pulley 60 will be defined as an opposing surface 40*a* (it can be considered that the opposing surface 40*a* includes the end face 46 of the small-diameter portion 42, the end face 47 of the large-diameter portion 45, and the end face 86 of the first rib 81 to the end face 89 of the fourth rib 84). When dusts enter, the dusts may reach the edge of the opposing surface 40*a* (the end face 47 of the large-diameter portion 45).

In addition to the through-hole 39, the recess 70 is formed in the opposing surface 40*a*. The recess 70 includes the third recess 73 that is located upwardly relative to an upper end 30*a* of the bearing 30 (see a line L4). Since the opposing surface 40*a* is directed horizontally, dusts move downwardly. However, since the pulley 60 is formed in a cylindrical shape with a bottom, when the pulley 60 rotates, an airflow is produced in the pulley 60.

Not only the gravity but also external force by airflow act on dusts. Some dusts enter the third recess 73 (the recess 70). The dusts that entered the third recess 73 become apart from the bearing 30. This keeps away the dusts from the bearing 30 in the horizontal direction, and thus the dusts are not likely to enter the bearing 30.

Even if the dusts that entered the third recess 73 (the recess 70) move toward the bearing 30, the movement distance until reaching to the bearing 30 is increased in comparison with a case in which dusts move on a flat surface where no third recess 73 (the recess 70) is formed. Hence, the dusts are not likely to reach the bearing 30.

Dusts are also likely to reach the outlet of the through-hole 39 by the same action as described above. Because of the above reasons, the lifetime of the water pump 10 can be extended.

In addition, the thickness T1 of the large-diameter portion 45 in the radial direction is thinner than the thickness T2 of the small-diameter portion 42. Hence, the further large recess 70 can be formed between the small-diameter portion 42 and the large-diameter portion 45. Dusts are further likely to enter the recess 70. This can keep the dusts away from the bearing 30, and thus the dusts are not likely to reach the bearing 30. Accordingly, the lifetime of the water pump 10 can be extended.

Moreover, the recess 70 is divided by the first rib 81 to the fourth rib 84, and the second rib 82 to the fourth rib 84 are located upwardly relative to the through-hole 39 (see a line L5). Even if dusts that entered into the recess 70 move toward the through-hole 39 along the surface of the recess 70, the second rib 82 to the fourth rib 84 interfere the flow of the dusts. This prevents the dusts from entering in the through-hole 39.

Furthermore, a turbulence flow of air is likely to be produced in the pulley 60 by forming the second rib 82 to the fourth rib 84. External force by the turbulence flow of air is likely to act on the dusts, making the dusts further difficult to reach the bearing 30. Accordingly, the lifetime of the water pump 10 can be extended.

Note that as far as the actions and advantageous effects of the present disclosure are achievable, the present disclosure is not limited to the embodiments. For example, although the description has been given of an example case in which the center line L1 of the bearing hole 41 of the support portion 40 extends in the horizontal direction, the direction in which the center line L1 extends is not limited to this example. Even if the center line L1 is designed so as to extend in the vertical direction or an oblique direction between the vertical direction and the horizontal direction, the present disclosure can achieve the same advantageous effects.

INDUSTRIAL APPLICABILITY

The water pump according to the present disclosure is suitably loaded on an engine of a power shovel, a vehicle, etc.

What is claimed is:

1. A water pump comprising:

a support portion provided with a bearing hole that supports a bearing;

a rotation shaft which is rotatably supported by the bearing and which passes completely through the bearing hole;

a pulley which is provided at one end of the rotation shaft and which is formed in a cylindrical shape with a bottom;

an impeller provided at an other end of the rotation shaft; and a sealing member placed between the impeller and the bearing, wherein:

the support portion is provided with a through-hole that permits a space between the sealing member and the bearing to be in communication with an exterior of the support portion;

the support portion comprises: an annular small-diameter portion provided with the bearing hole at a center; and an annular large-diameter portion that has a larger diameter at an outer circumference than a diameter of an outer circumference of the small-diameter portion;

at least a part of the small-diameter portion is located at the pulley side relative to the large-diameter portion;

an annular first clearance sized to prevent dust from entering therein is formed between a cylindrical portion of the pulley and the large-diameter portion;

a second cylindrical portion is provided on the bottom portion of the pulley; and an annular second clearance sized to prevent dust from entering therein is formed between the second cylindrical portion and the small-diameter portion.

2. The water pump according to claim 1, wherein:

a dimension in an axial direction in which the cylindrical portion of the pulley and the large-diameter portion of the support portion overlap with each other is defined as a first dimension;

a dimension in the axial direction in which the second cylindrical portion and the small-diameter portion of the support portion overlap with each other is defined as a second dimension; and the first dimension is shorter than the second dimension.

3. The water pump according to claim 2, wherein a dimension of at least either one of the first clearance or the second clearance in a radial direction is designed so as to decrease toward the impeller with reference to a direction in which a center line of the bearing hole extends.

4. The water pump according to claim 2, wherein:
the support portion comprises an opposing surface that faces with the bottom portion of the pulley; and
recesses are formed in the opposing surface in addition to the through-hole.

5. The water pump according to claim 4, wherein:
the large-diameter portion surrounds the small-diameter portion;
with reference to a radial direction, a thickness of the large-diameter portion is thinner than a thickness of the small-diameter portion; and
the recess is formed by a space between the small-diameter portion and the large-diameter portion.

6. The water pump according to claim 5, wherein a plurality of ribs is formed from the outer circumference of the small-diameter portion to an inner circumference of the large-diameter portion.

7. The water pump according to claim 4, wherein:
a center line of the bearing hole extends in a horizontal direction; and
some of the recesses formed in the opposing surface are located upwardly relative to an upper end of the bearing.

8. The water pump according to claim 1, wherein a dimension of at least either one of the first clearance or the second clearance in a radial direction is designed so as to decrease toward the impeller with reference to a direction in which a center line of the bearing hole extends.

9. The water pump according to claim 8, wherein:
the support portion comprises an opposing surface that faces with the bottom portion of the pulley; and
recesses are formed in the opposing surface in addition to the through-hole.

10. The water pump according to claim 9, wherein:
the large-diameter portion surrounds the small-diameter portion;
with reference to a radial direction, a thickness of the large-diameter portion is thinner than a thickness of the small-diameter portion; and
the recess is formed by a space between the small-diameter portion and the large-diameter portion.

11. The water pump according to claim 10, wherein a plurality of ribs is formed from the outer circumference of the small-diameter portion to an inner circumference of the large-diameter portion.

12. The water pump according to claim 9, wherein:
a center line of the bearing hole extends in a horizontal direction; and
some of the recesses formed in the opposing surface are located upwardly relative to an upper end of the bearing.

13. The water pump according to claim 1, wherein:
the support portion comprises an opposing surface that faces with the bottom portion of the pulley; and
recesses are formed in the opposing surface in addition to the through-hole.

14. The water pump according to claim 13, wherein:
the large-diameter portion surrounds the small-diameter portion;
with reference to a radial direction, a thickness of the large-diameter portion is thinner than a thickness of the small-diameter portion; and
the recess is formed by a space between the small-diameter portion and the large-diameter portion.

15. The water pump according to claim 14, wherein a plurality of ribs is formed from the outer circumference of the small-diameter portion to an inner circumference of the large-diameter portion.

16. The water pump according to claim 15, wherein:
a center line of the bearing hole extends in a horizontal direction; and
some of the recesses formed in the opposing surface are located upwardly relative to an upper end of the bearing.

17. The water pump according to claim 14, wherein:
a center line of the bearing hole extends in a horizontal direction; and
some of the recesses formed in the opposing surface are located upwardly relative to an upper end of the bearing.

18. The water pump according to claim 13, wherein:
a center line of the bearing hole extends in a horizontal direction; and
some of the recesses formed in the opposing surface are located upwardly relative to an upper end of the bearing.

* * * * *